US007675415B2

(12) United States Patent
Yang

(10) Patent No.: US 7,675,415 B2
(45) Date of Patent: Mar. 9, 2010

(54) METHOD FOR CONTROLLING SECURITY TRUCK DOOR LOCKER AND STRUCTURE FOR CONTROLLING SECURITY TRUCK DOOR LOCKER

(76) Inventor: Ping-Jan Yang, P.O. Box 26-757, Taipei 106 (TW)

( * ) Notice: Subject to any disclaimer, the term of this patent is extended or adjusted under 35 U.S.C. 154(b) by 354 days.

(21) Appl. No.: 11/809,138

(22) Filed: Jun. 1, 2007

(65) Prior Publication Data

US 2008/0297344 A1 Dec. 4, 2008

(51) Int. Cl.
*E05B 45/06* (2006.01)

(52) U.S. Cl. ..... 340/542; 340/545.1; 340/555; 340/5.71

(58) Field of Classification Search ..... 340/542, 340/549, 545.1, 545.3, 545.5, 545.6, 545.8, 340/545.9, 555, 593, 5.72, 5.73, 5.71, 14.69, 340/308

See application file for complete search history.

(56) References Cited

U.S. PATENT DOCUMENTS 3,933,382 A * 1/1976 Counts et al. ..... 292/144
4,204,635 A * 5/1980 Hofmann et al. ..... 235/382
4,836,352 A * 6/1989 Tateno et al. ..... 194/215
5,056,847 A * 10/1991 Stillwell et al. ..... 296/50
5,058,258 A * 10/1991 Harvey ..... 29/401.1
5,532,521 A * 7/1996 Leininger ..... 307/10.2
2006/0220457 A1* 10/2006 Yabumoto ..... 307/10.2

* cited by examiner

*Primary Examiner*—Daniel Previl
(74) *Attorney, Agent, or Firm*—Rosenberg, Klein & Lee

(57) ABSTRACT

A method for controlling security truck door lockers and a structure for controlling security truck door lockers are disclosed. A control device is configured to control electronic lockers respectively mounted on security truck doors by means of detecting the unlocked/locked status of the electronic lockers and changing or not changing their status accordingly, and then informing users of the locker's current status. The electronic locker includes a substrate, a fastener, a stopper, a micro switch, and a locker core. When a bolt of the door fastens the fastener, the stopper horizontally moves to contact a bottom of the fastener by means of controlling the operation of the micro switch, or the locker core drives an engagement portion to contact the fastener so that the fastener is fastened and the locker is locked.

24 Claims, 9 Drawing Sheets

METHOD FOR CONTROLLING SECURITY TRUCK DOOR LOCKER AND STRUCTURE FOR CONTROLLING SECURITY TRUCK DOOR LOCKER

BACKGROUND OF THE INVENTION

1. Field of the Present Invention

The present invention generally relates to a method for controlling security truck door lockers and a structure for controlling security truck door lockers. More particularly, the present invention relates to a method for controlling security truck door lockers and a structure for controlling security truck door lockers in which a control device detects the unlocked/locked status of an electronic locker and changes the status accordingly, and then informs users of the current status of the electronic locker. The electronic lockers can be controlled in either an automatic-mode or manual-mode to lock and unlock.

2. Description of the Related Art

Transport via land costs much less and is much safer than transport via air or sea. However, vehicles loaded with valuable goods can be a big target for robbers.

Security trucks, which are commonly used for transporting goods, have bolts on external surfaces of their doors to lock the doors. Since the doors are difficult to open whilst driving, most robberies happen when the security trucks have stopped. Security trucks are always bulky and have multiple dead spaces where it is difficult for the drivers or operators to view the surrounding area. If the drivers or operators fail to pay close attention, the bolts are easily removed so that the doors can be opened and the goods inside access accessed, especially tiny and highly valuable electronic products such as chips or microprocessors. Once those highly valuable goods have been stolen, they are difficult to find and return to their rightful owners. Therefore, it is critical that security firms prevent robberies of security trucks.

An approach in which electronic locks are mounted on respective doors and controlled by a central control system has been previously proposed. Under that approach, electronic lockers are only unlocked from a central control system and the door(s) are opened manually only when loading and unloading. After loading or unloading, the electronic locks are locked again to prevent the doors from being unintentionally opened.

However, the above locking/unlocking mechanism has some disadvantages.

For example, even though all of the doors can be locked or unlocked at the same time by operators, the doors on the sides of the dead space of a bulky security truck are easily opened by a robber. In this circumstance, when the operators are busy unloading/loading goods at some of the doors, other opened doors can be used as an entrance for the robbers to enter the truck.

The unlocking and locking of all electronic lockers are controlled only by the operators. If the operators forget to lock the doors after loading or unloading goods, robberies can occur.

The operators cannot be informed of the current status of the electronic lockers in a timely manner, so they may misjudge the locking and unlocking operation for the lockers.

Furthermore, the operators control the locking and unlocking of the lockers from the driver's seat. If they leave the seat, others are able to take control of the electronic lockers. That raises security issues, too.

The inventors have investigated the control of security truck door lockers and finally found an improved method and a novel structure for controlling the electronic lockers of security truck doors.

SUMMARY OF THE INVENTION

It is an object of the present invention to provide a method for controlling the electronic lockers of security truck doors, in which a control device checks and controls the locking and unlocking of all electronic lockers and informs users of their current status. Therefore, the users can confirm if the doors are controlled as desired and keep the goods in the security truck secure.

It is another object to provide a structure of controlling the electronic lockers of security truck doors in electronic mode or hand mode.

In order to achieve the above objectives, a method for controlling the electronic lockers of security truck doors includes turning on the control device; detecting the micro switch in the electronic lockers by using the control device to confirm if they are locked, locking the electronic lockers via the micro switch, and informing users of the status of the electronic lockers; unlocking the electronic lockers via the control device, wherein the control device simultaneously informs the users of the status of the electronic lockers; monitoring the unlocked electronic lockers via the control device to determine whether they have not been operated for a first time period; after the first time period, the control device drives the micro switch to lock the unlocked electronic lockers and informs the users of the status of the electronic lockers; monitoring the unlocked electronic lockers via the control device to determine if they are open during the first time period; if the doors are open, then the control device cancels the counting operation for the first time period until the user closes the door; closing the truck doors, and driving the micro switch via the control device to lock the truck doors in a second time period and then informing the user of the status of the electronic lockers.

According to the above method, users can control the micro switch of the electronic lockers by using the control device for the locking/unlocking operation to open or close the doors as needed, while keeping the idle doors closed when goods are not being loaded or unloaded. Meanwhile, the operation status is fed back to keep users informed of the truck's security.

The present invention further provides a security truck door locker, including a substrate at a front end of which a rotating fastener is pivotally mounted with a receiving space between the substrate and the fastener. A hook is mounted on the top of the fastener to enclose the receiving space. The fastener has a stopper at its bottom. A reciprocating mechanism is pivotally mounted on a rear side of the fastener to provide the stopper with a reciprocating force. A locker core is mounted on a front side of the substrate opposite the bottom of the fastener. A rotating plate extends from a rear of the locker core. A positioning block is pivotally mounted on the rotating plate to rotate forwards and backwards inside the receiving space along the stopper rotating path. A micro switch is mounted on a rear of the substrate. A movable rod extends from a bottom of the micro switch, and a stopping element is fixedly connected to the movable rod opposite the rear of the positioning block to stop the positioning block.

In the above configuration, the micro switch controls the operation of the movable rod so that the stopping element stops or withdraws from the positioning block in a vertical direction. Alternatively, the locker core drives the positioning block to rotate in order to reach the rear of the stopper and abut against or depart from the stopper, thereby the fastener is locked or unlocked.

To provide a further understanding of the present invention, the following detailed description illustrates embodiments and examples of the present invention, this detailed description being provided only for illustration of the present invention.

DETAILED DESCRIPTION OF THE PREFERRED EMBODIMENTS

Figure 1:
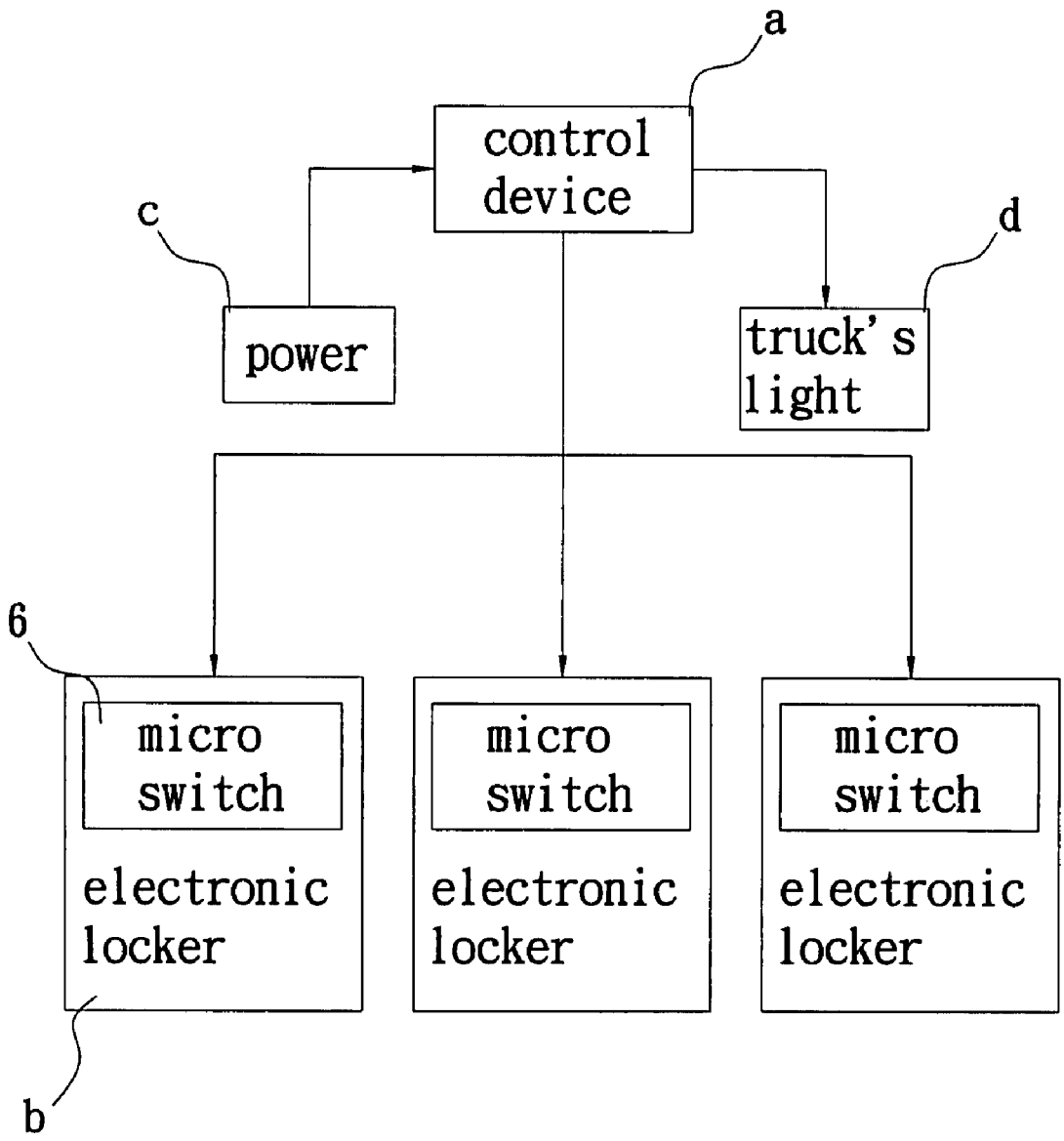
FIG. 1 is a schematic view of controlling security truck door lockers according to a first embodiment of the present invention.

Wherever possible in the following description, like reference numerals will refer to like elements and parts unless otherwise illustrated.

The term "locker" is used to describe an apparatus or mechanism which locks, the use does not include lockable containers.

Figure 2:
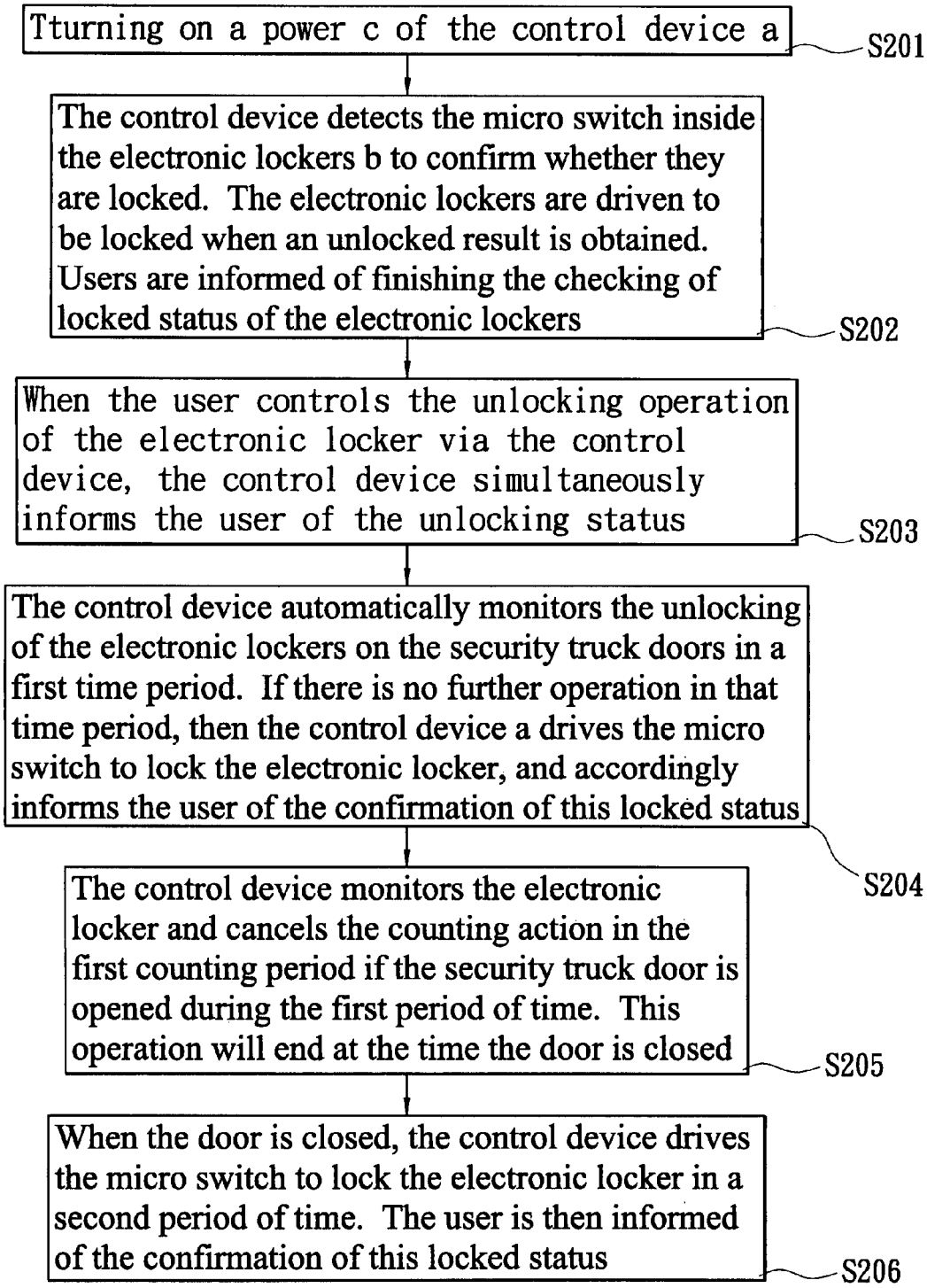
FIG. 2 is a flow chart of a method for controlling security truck door lockers according to a first embodiment of the present invention.

Referring to FIG. 1 and FIG. 2, the structure for controlling security truck door lockers according to a first embodiment of the present invention includes a control device a. The control device a can be a remote control or a for-vehicle-use control box. The control device a respectively connects to electronic lockers b on corresponding side doors of the security truck in a wired or wireless manner and connects to the truck's lights d. Each of the electronic lockers b has a micro switch 6 which connects to the truck's lights d. The control device a further has LEDs.

The method for controlling security truck door lockers includes the following steps:

Step S201: turning on a power c of the control device a; the power c is powered by a battery used for the security truck or an outside battery.

Step S202: the control device a detects the micro switch 6 inside the electronic lockers b to confirm whether they are locked. The electronic lockers b are driven to be locked when an unlocked result is obtained. Users are informed of the completion of checking the locked status for the electronic lockers. After the control device a finishes checking the locked status, users are informed by means of flashing the LEDs of the control device a and by means of switching the power c of the truck's lights d. Therefore, actuating the LEDs, flashing the truck's lights twice, or flashing the LEDs notifies users that the checking process is completed.

Step S203: When the user controls the unlocking operation of the electronic locker b via the control device a, the control device a simultaneously informs the user of the unlocked status. The unlocking status is indicated by a lighting up of the LEDs on the control device a.

Step S204: The control device an automatically monitors the unlocking of the electronic lockers on the security truck doors in a first time period. If there is no further operation in that time period, the control device a drives the micro switch 6 to lock the electronic locker b, and accordingly informs the user of the confirmation of this locked status. The first period of time is set to 20 seconds. The informing action of the locked status will end as the first period of time is over. The locked message is then shown by flashing the truck's lights d once.

Step S205: The control device a monitors the electronic locker b and cancels the counting action in the first counting period if the security truck door is opened during the first period of time. This operation will end at the time the door is closed.

Step S206: When the door is closed, the control device a drives the micro switch 6 to lock the electronic locker b in a second period of time. The user is then informed of confirmation of this locked status. The second period of time is set to 1 second, for example. At Step S203, the status informing action will end as the second period of time is over. The locked status is then shown by flashing the truck's lights d once.

In the above method, as shown in FIG. 1 and FIG. 2, Step S201 and Step S202 are performed to turn on the control device a and confirm that the electronic lockers b are in locked status. When loading or unloading, at Step S203 the control device a unlocks all electronic lockers b of the security truck doors. Meanwhile, the control device a notifies the user of the unlocked status. At Step S204, the control device a drives the micro switches 6 of the electronic lockers b to lock the idle doors if no further action is taken during the first period of time. The locked status is indicated by a flashing of the lights d. Only those doors through which goods are being loaded or unloaded are kept open during Step S205. When the user closes any of the doors, the control device a then drives the micro switches 6 of the electronic lockers b in the second period of time (Step S206). The locked status is indicated by a flashing of the truck's lights d. Since the unlocked or locked messages are indicated by a flashing of the truck's lights d or the LEDs, the user can easily know the status of any doors, thereby preventing any unintentional opening or closing of the doors and maintaining the safety of the goods in the security truck.

Figure 3:
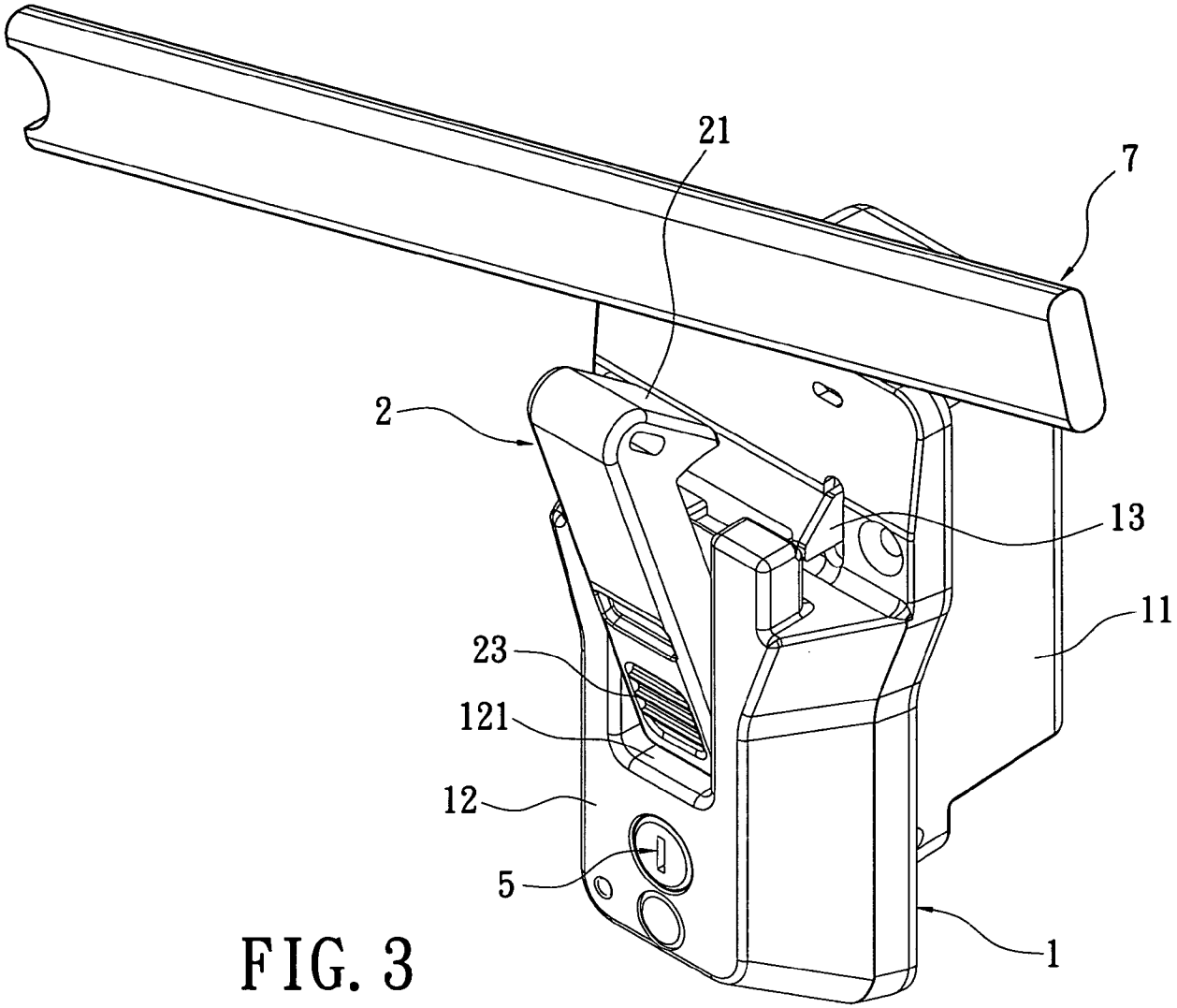
FIG. 3 is a perspective view of a structure for controlling security truck door lockers according to a first embodiment of the present invention.
Figure 4:
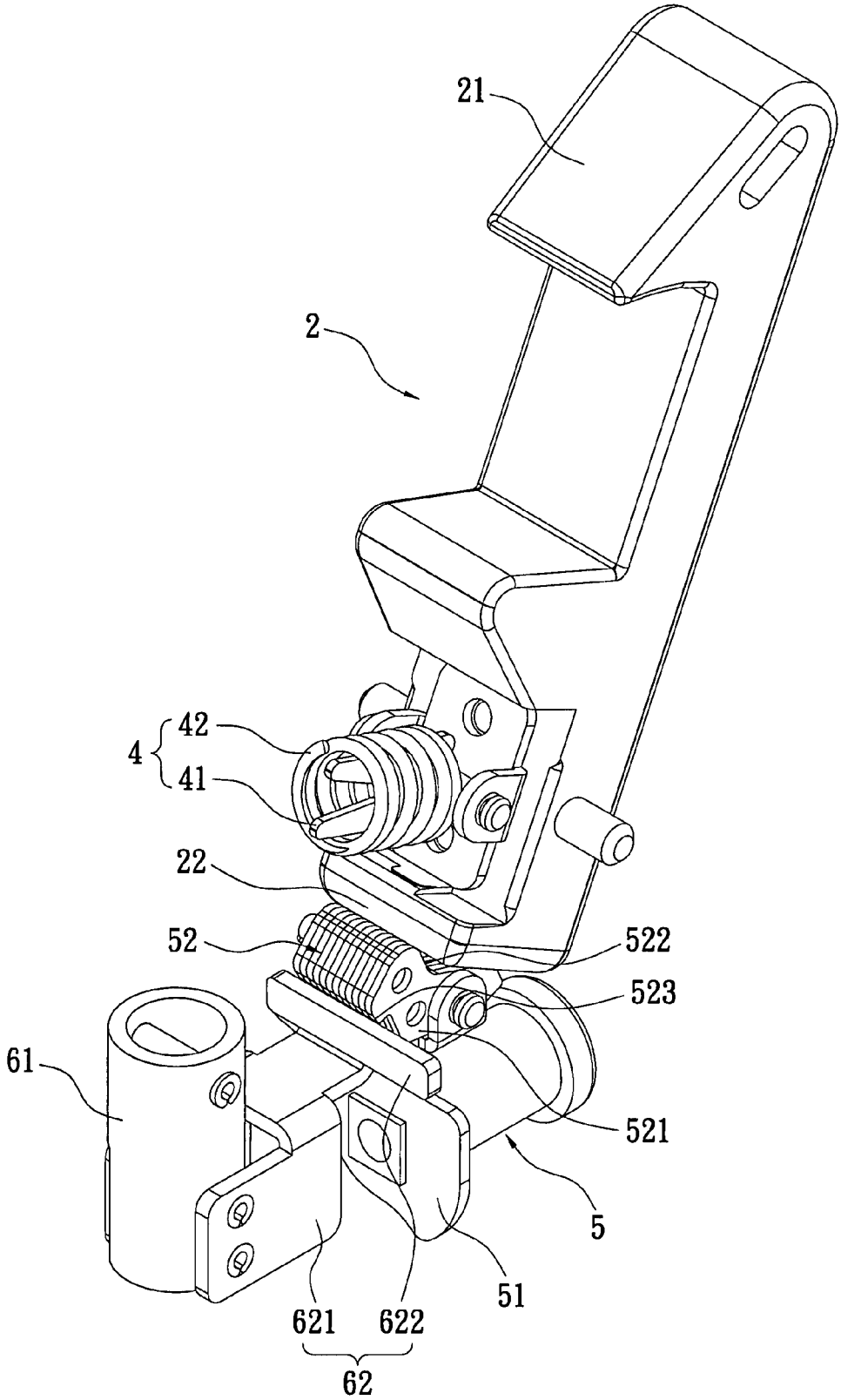
FIG. 4 is a cross sectional view of a structure for controlling security truck door lockers according to a first embodiment of the present invention.

As shown in FIG. 3 and FIG. 4, each electronic locker b stops and restricts the movement of bolts 7 for the respective doors. The electronic locker b includes a substrate 1, a rotating fastener 2, a stopper 3, a reciprocating mechanism 4, and a locker core 5, and the micro switch 6. A casing 11 is mounted on a rear end of the substrate 1, and a lid 12 is mounted on a front end of the substrate 1. The lid 12 has a recess 121 at its top.

Figure 5:
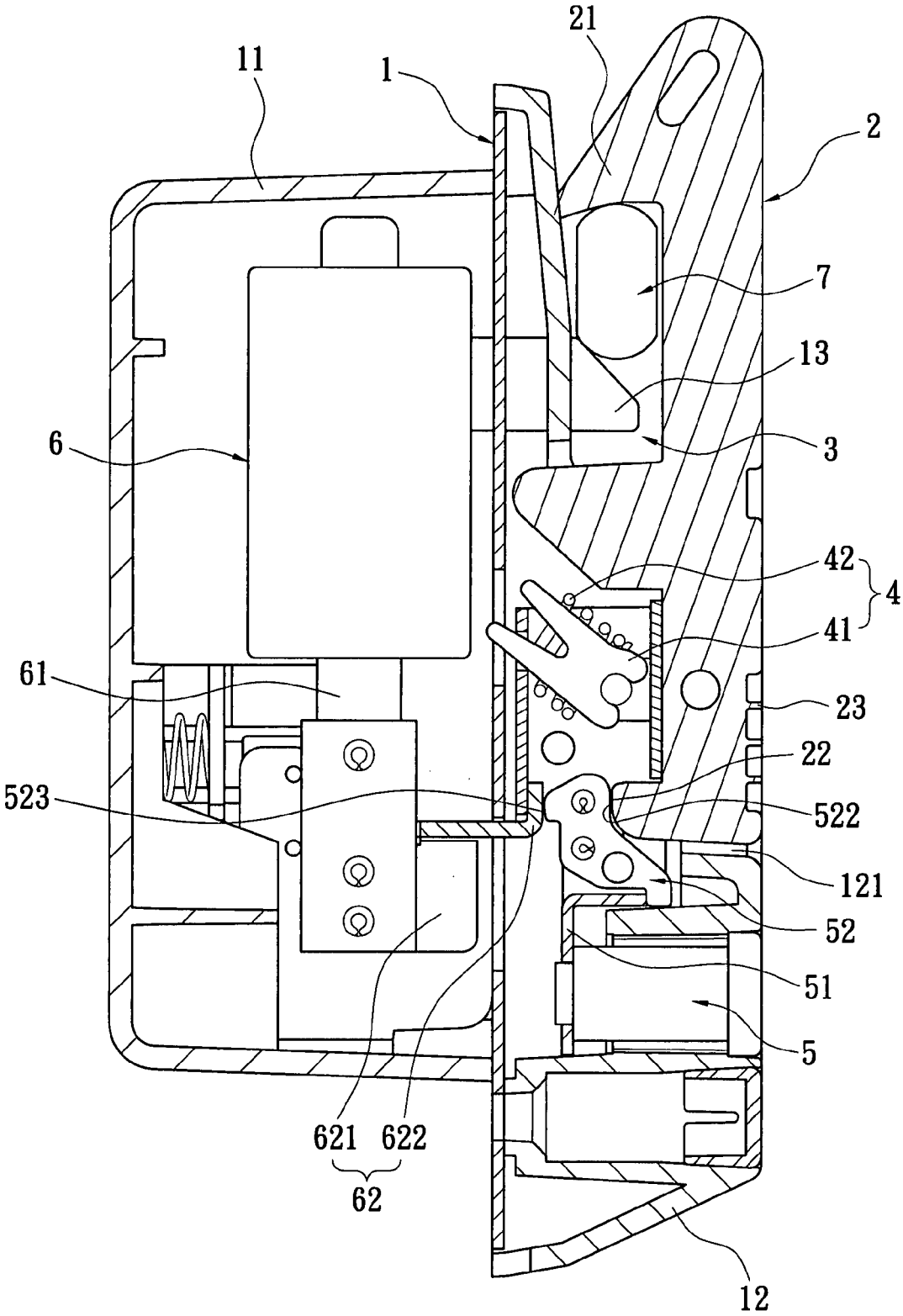
FIG. 5 is a first cross sectional view of a structure for controlling security truck door lockers according to a first embodiment of the present invention.
Figure 6:
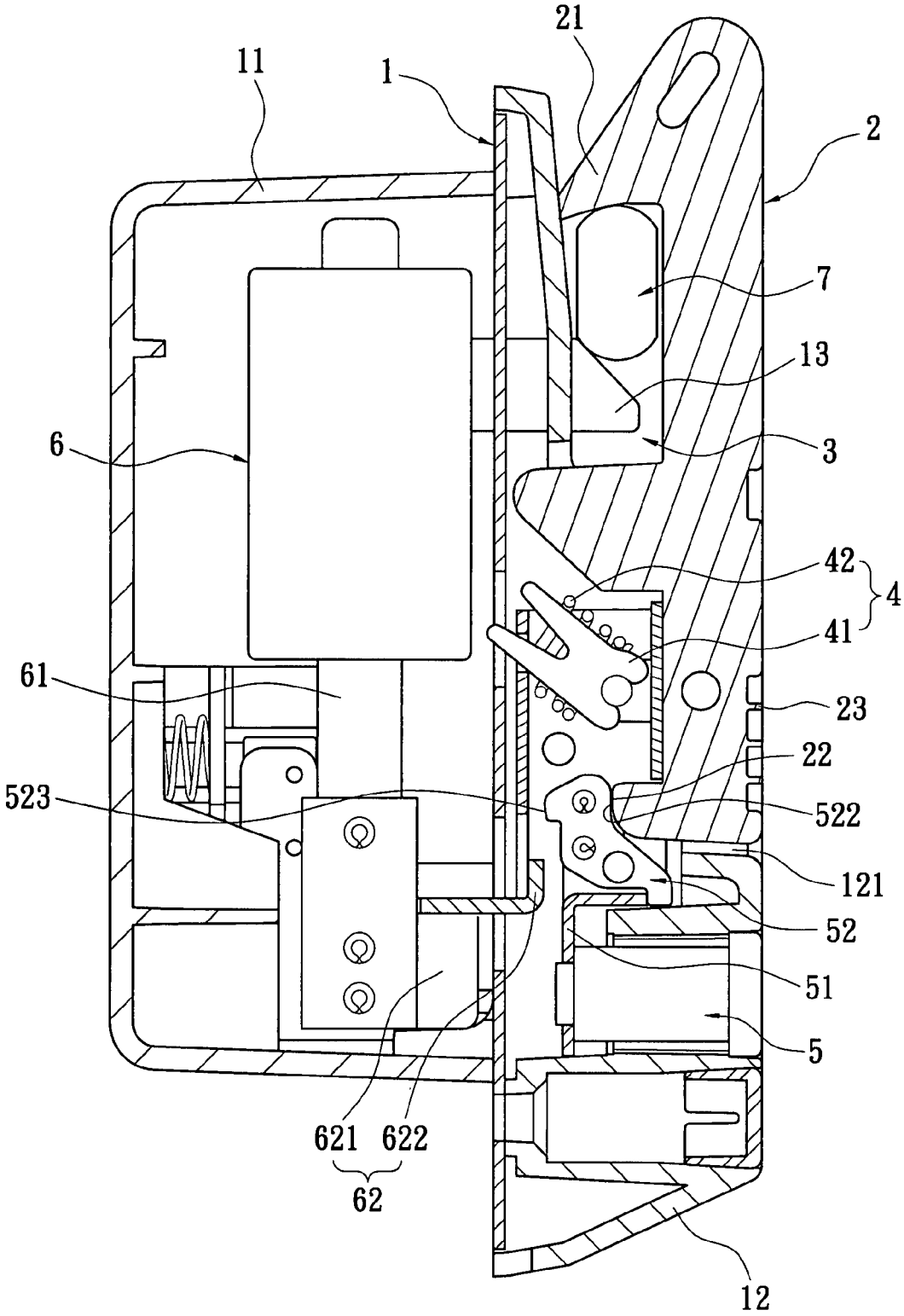
FIG. 6 is a second cross sectional view of a structure for controlling security truck door lockers according to a first embodiment of the present invention.

As shown in FIG. 4, FIG. 5, and FIG. 6, both sides of the rotating fastener 2 are pivotally mounted on inner sides of the recess 121 in a manner in which the fastener 2 pivots against the substrate 1. Between the substrate 1 and the fastener 2 a receiving space 3 is formed where a hook 21 mounted on the top of the fastener 2 engages. The fastener 2 has a stopper 22 at its bottom. The fastener 2 has slipping-stop patterns 23 at its lower section. A protruding sheet 13 penetrates through rear sides of the substrate 1 to horizontally extend into the receiving space 3.

The reciprocating mechanism 4 is pivotally mounted on a rear side of the fastener 2. The reciprocating mechanism 4 has a resilient arm 41 one end of which is pivotally connected to two rear ends of the fastener 2. The resilient arm 41 is inserted through an anti-press spring 42 which offers the stopper 22 the reciprocating force.

A locker core 5 is embedded on the lid 12 of the substrate 1. A rotating plate 51 further extends from the rear side of the locker core 5 opposite to the bottom of the fastener 2. A positioning block 52 is pivotally mounted on the rotating plate 51 in a manner in which the positioning block 52 can rotate forwards and backwards. The positioning block 52 corresponds to the receiving space 3 and has a plurality of positioning pieces 521 laminated upon one another. The positioning block 52 has a first positioning face 522, at its front top side so that the first positioning face 522 is located in the rotating path of the stopper 22 and can abut against the stopper 22. The positioning block 52 has a second positioning face 523 at its rear.

The micro switch 6 is mounted on the rear side of the substrate 1 and covers the casing 11. A movable rod 61 extends from a bottom of the micro switch 6. A stopping element 62 is fixedly mounted on one side of the movable rod 61, opposite to the rear end of the positioning block 52. The stopping element 62 has a rack 621 fixedly mounted on a front side of the movable rod 61. A limiting piece 622 is bent upward from a front side of the rack 621 to correspondingly limit the second positioning face 523 of the positioning block 52.

In the above embodiments, as shown in FIG. 3 and FIG. 5, when small-sized and highly valuable electronic goods such as microprocessors and electronic cards have been loaded and the operator is about to close the truck door, he or she may press down the slipping-stop pattern 23 on a lower surface of the fastener 2 so that the stopper 22 of the fastener 2 pushes the positioning block 52 to rotate forward so that the hook 21 of the fastener 2 withdraws back from the receiving space 3.

At this time, the operator puts the bolt 7 of the truck door in the receiving space 3 and then presses down upon an upper section of the fastener 2. The reciprocating mechanism 4 provides the stopper 22 a reciprocating force to force the fastener 2 to return to its original position. The truck's door is thereby closed.

Subsequently, the operator actuates the micro switch 6 by using a remote control or central control system to drive the movable rod 61 to move upward so that the limiting piece 622 of the stopping element 62 stops the second positioning face 523 of the positioning block 52 in a vertical direction. The positioning block 52 is thereby limited so that it cannot rotate backward. When the stopper 22 of the fastener 2 rotates backward, the fastener 2 is stopped by the first positioning face 522 of the positioning block 52 and thus kept at a certain position. The hook 21 of the fastener 2 further encloses the receiving space 3. The bolt 7 is thereby locked.

Figure 7:
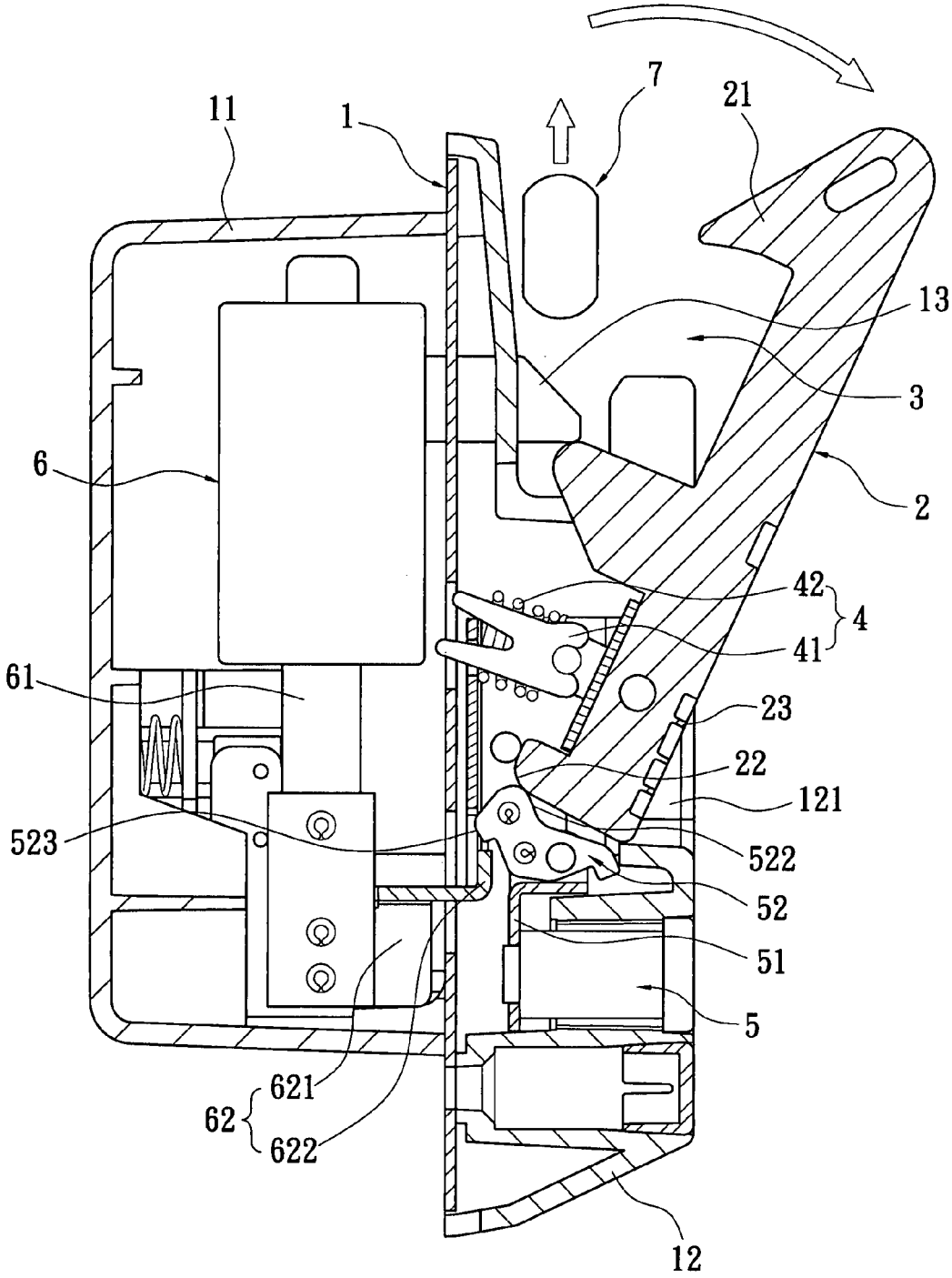
FIG. 7 is a third cross sectional view of a structure for controlling security truck door lockers according to a first embodiment of the present invention.

As shown in FIG. 6 and FIG. 7, when the locker is to be unlocked, the operator actuates the micro switch 6 by using the central control system to drive the movable rod 61 to move downward so that the limiting piece 622 of the stopping element 62 withdraws from the second positioning face 523 of the positioning block 52 in a vertical direction to allow the positioning block 52 to freely rotate backward. The locker is thereby unlocked. Then the operator can press down upon the slipping-stop pattern 23 on the lower surface of the fastener 2 so that the stopper 22 of the fastener 2 pushes the first position face 522 of the positioning block 52 back and thus the hook 21 of the fastener 2 withdraws from the receiving space 3. Thereby the bolt 7 inside the receiving space 3 can freely withdraw from the receiving space 3.

Figure 8:
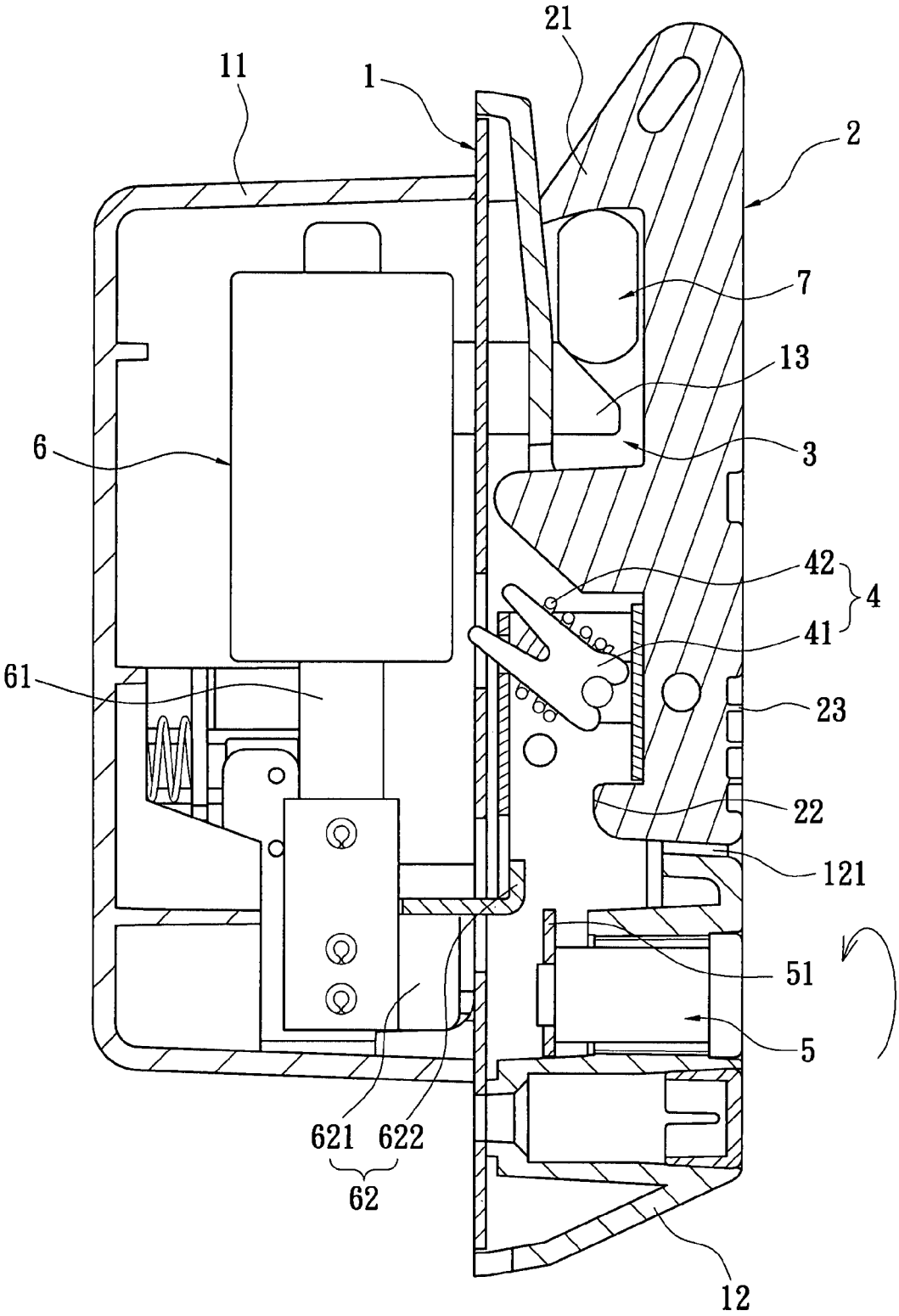
FIG. 8 is a first perspective view of a structure of a structure for controlling security truck door lockers according to a first embodiment of the present invention.
Figure 9:
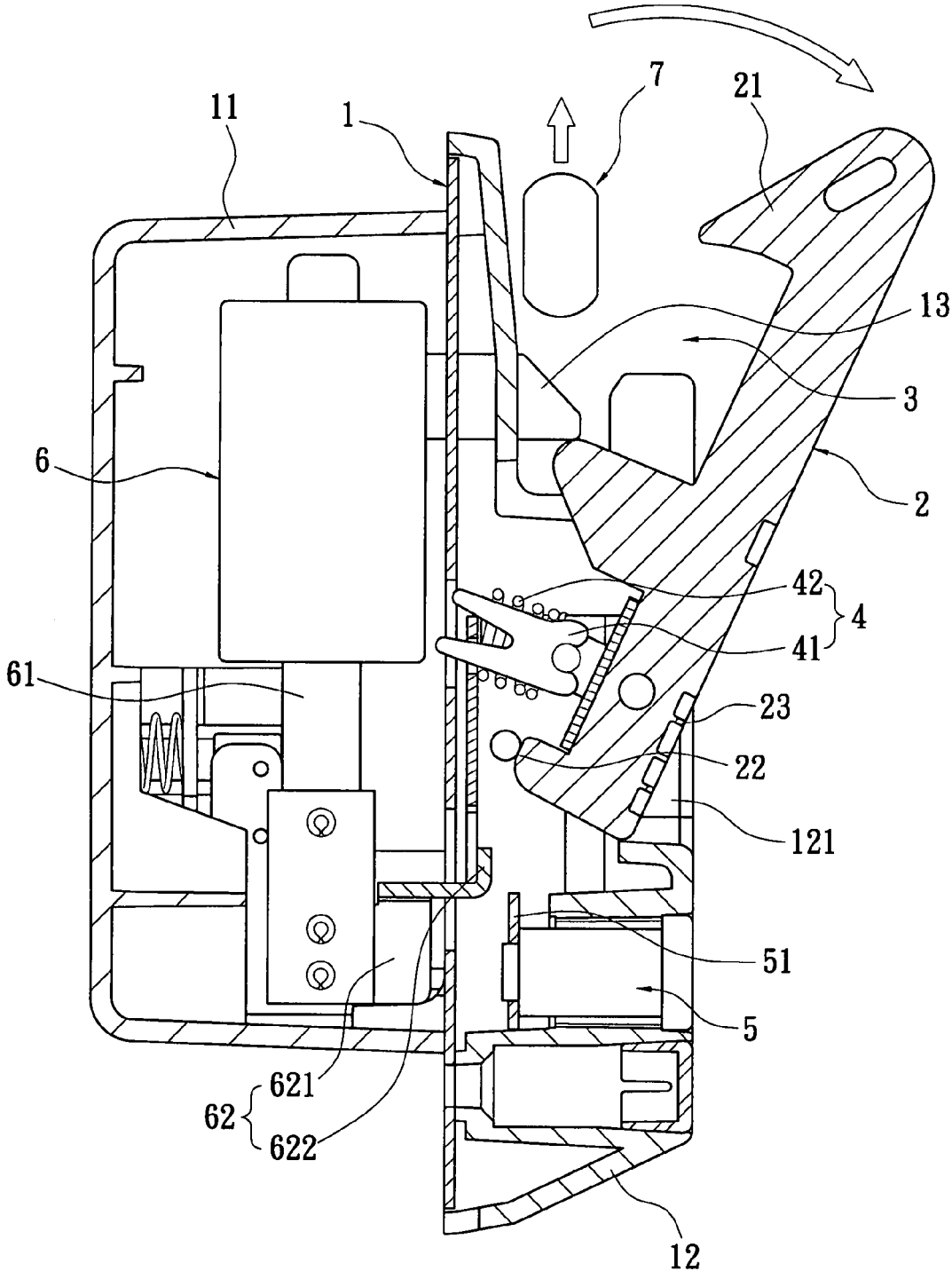
FIG. 9 is a second perspective view of a structure for controlling security truck door lockers according to a first embodiment of the present invention.

As shown in FIG. 8 and FIG. 9, alternatively, the operator can manually insert a key into the locker core 5 to drive the rotating plate 51 to rotate so that the positioning block 52 rotates until it reaches the rear of the stopper 22. The stopper 22 is thereby restricted so that it cannot be pushed backwards inside the receiving space 3 and the hook 21 of the fastener 2 seals the receiving space 3. The bolt 7 is thereby closed.

In other circumstances, the operator can insert a key into the locker core 5 to drive the rotating plate 5 to rotate until the stopper 22 can freely move back inside the receiving space 3 to unlock the locker. When the operator presses down upon the slipping-stop pattern 23 of the fastener 2 to rotate the fastener 2, the stopper 22 rotates backwards without interfering with the fastener 2. The bolt 7 can withdraw from the receiving space 3 as the hook 21 of the fastener 2 withdraws from the receiving space 3. Thereby, the operator can open the truck door.

In the view of the foregoing, the invention provides the following advantages over the prior art:

1. By means of the above steps, all the electronic lockers b can be unlocked or locked only through the control of the control device a. An unlocked or locked status is simultaneously indicated by a flashing of the truck's lights d or LEDs so that the user can confirm the status of the electronic lockers b for all the doors by checking notified messages sent from the control device a. Compared with the conventional method in which the users have to watch the status of the whole bulky security truck but can easily overlook dead spaces in which robberies can easily occur, the present invention provides higher security during transport and unloading/loading.
2. When the user unlocks all the electronic lockers b via the control device a, idle doors can be controlled at Step S204 in which if the doors are not manually operated in the first time period, then the micro switch 6 drives the electronic lockers b to lock. The user is informed of the locked status by a flashing of the truck's lights d. In this way, the user can more easily notice and control the security of the security truck.
3. When the user leaves for a short period when loading or unloading goods, the flashing of the security truck's lights d and LEDs of the control device a keeps the user informed of the status of the security truck, thereby increasing the security of the goods being transported.
4. After the control device is actuated, automatic checking of the locked/unlocked status of all of the electronic lockers b is performed. If they are unlocked, then the micro switch 6 drives the target lockers to lock automatically. This checking action ensures all the electronic lockers b are locked, preventing any confusion in the subsequent operation of the electronic lockers b and helping the user to control the status of the electronic lockers b.
5. In the present invention, the operator can use either the central control system or the remote control to unlock the lockers, or use a key to manually unlock the lockers. A key reserve issue which occurs in the prior art is no longer a problem. Furthermore, it is more convenient for the user to control the locking/unlocking of the security truck doors.

6. The user does not need to lock or unlock the lockers manually. If the user finds the security truck door unlocked during transport, then the central control system or the remote control can be used to lock the doors immediately.

7. When the user leaves the security truck for a short period of time when loading or unloading the transported goods, the micro switch 6 can be actuated by a remote control; thereby the guards do not have to be concerned about dead spaces around the security truck. Therefore, robberies due to careless unlocking can be prevented and the security of the goods being transported is increased.

8. When the micro switch 6 is not working and it cannot be unlocked via the central control system or the remote control, it can be manually unlocked via a key. Therefore the loading and unloading good will not affected by such an accidental locking issue.

It should be apparent to those skilled in the art that the above description is only illustrative of specific embodiments and examples of the present invention. The present invention should therefore cover various modifications and variations made to the herein-described structure and operations of the present invention, provided they fall within the scope of the present invention as defined in the following appended claims.

What is claimed is:

1. A method for controlling electronic lockers of security truck doors with a control device mounted on electronic lockers, the method comprising:

turning on the control device;

detecting a micro switch of each of the electronic locker by using the control device to confirm whether the micro switches are locked, if the micro switches are not locked, the control device drives the micro switches locked; and in turn informs users status of all the micro switches;

unlocking the electronic lockers by action of the control device, wherein the control device simultaneously informs users of the status of the micro switches which are unlocked;

monitoring the truck doors with the electronic lockers via the control device to recognize whether the truck doors have been opened during a first time period, if, A) the truck doors have not been opened during the first time period: after the first time period, the control device drives the micro switch to lock and conforms with the users of the status of the micro switches which are locked;

B) the truck doors have been opened, and then the control device cancels a counting operation of the first time period until the user closes the doors; and closing the truck doors, and driving the micro switch by the control device to lock the truck doors for a second time period and then informing the user of the confirmation of the status of the micro switches which are locked.

2. The method of claim 1, wherein finishing the checking of the status of the micro switches which are locked are indicated by a flashing of LEDs on the control device.

3. The method of claim 2, wherein finishing the checking of the status of the micro switches which are locked are indicated by turning on an LED, flashing the truck's lights and then turning off the LED.

4. The method of claim 1, wherein finishing the checking of the status of the micro switches which are locked are indicated by a flashing of the truck's light.

5. The method of claim 4, wherein finishing the checking of the status of the micro switches which are locked are indicated by turning on the LEDs, flashing the truck's lights and then turning off LEDs.

6. The method of claim 1, wherein finishing the checking of the status of the micro switches which are locked are indicated by flashing the truck's lights twice.

7. The method of claim 1, wherein the status of the micro switches which are unlocked are indicated by flashing the LEDs on the control device.

8. The method of claim 7, wherein notifying of the status of the micro switches which are unlocked are end when the first time period is over.

9. The method of claim 7, wherein notifying of the status of the micro switches which are unlocked are end when the second time period is over.

10. The method of claim 1, wherein confirming the status of the micro switches which are locked are indicated by a flashing of the truck's lights.

11. The method of claim 10, wherein confirming the status of the micro switches which are locked are indicated by a flashing of the truck's lights once.

12. The method of claim 1, wherein the first time period is 20 seconds.

13. The method of claim 1, wherein the second time period is 1 second.

14. A structure for controlling a security truck's door lockers, comprising:

a substrate, a front end of which has a fastener pivotally mounted thereon, with a receiving space between the substrate and the fastener, a hook being mounted on a top of the fastener to enclose the receiving space, a stopper is located at the bottom of the fasten, and a reciprocating mechanism being pivotally mounted on a rear of the fastener to provide the stopper with a reciprocating force;

a locker core, mounted on a front side of the substrate opposite to the bottom of the fastener; a rotating plate extending from a rear of the locker core; a positioning block being pivotally mounted on the rotating plate to rotate forward and backward inside the receiving space; and a micro switch, mounted on a rear of the substrate, a movable rod extending from a bottom of the micro switch, and a stopping element being fixedly connected to the movable rod opposite to the rear of the positioning block to stop the positioning block;

wherein either the micro switch controls the movable rod such that the stopping element stops or withdraws from the positioning block in a vertical direction, or the locker core drives the positioning block to rotate to reach the rear of the stopper and abut against the stopper or leave from the stopper so that the fastener is to locked or unlocked.

15. The structure for controlling a security truck's door lockers of claim 14, wherein the reciprocating mechanism has a resilient arm, one end of which is pivotally connected to two ends at a rear side of the fastener, and the resilient arm penetrates through an anti-press spring.

16. The structure for controlling a security truck's door lockers of claim 14, wherein the positioning block consists of a plurality of positioning sheets.

17. The structure for controlling a security truck's door lockers of claim 14, wherein the positioning block has a first positioning face at its front top, corresponding to the stopper.

18. The structure for controlling a security truck's door lockers of claim 14, wherein the positioning block has a second positioning face at its rear top, corresponding to the stopper.

19. The structure for controlling a security truck's door lockers of claim 14, wherein the stopper has a rack at a front side of the movable rod, and a limiting sheet is bent upward from a front side of the rack.

20. The structure for controlling a security truck's door lockers of claim 14, wherein the fastener has slipping-stop pattern at its lower surface.

21. The structure for controlling a security truck's door lockers of claim 14, wherein the substrate has a casing at its rear end to enclose the micro switch.

22. The structure for controlling a security truck's door lockers of claim 14, wherein the substrate has a lid at its front end, the lid having a recess at two sides to which the fastener is pivotally connected so that the fastener pivotally opens opposite to the substrate.

23. The structure for controlling a security truck's door lockers of claim 22, wherein the locker core is embedded on the lid.

24. The structure for controlling a security truck's door lockers of claim 14, wherein a protruding sheet is mounted on rear sides of the substrate in a fashion to penetrate through the substrate to horizontally extend into the receiving space.

* * * * *